US005755297A

United States Patent [19]

Young et al.

[11] Patent Number: 5,755,297

[45] Date of Patent: *May 26, 1998

[54] ROTARY CONE DRILL BIT WITH INTEGRAL STABILIZERS

[75] Inventors: John Randolph Young, Southlake, Tex.; Norman Gair Mitchell, Aberdeen, United Kingdom; Paul Ronald Riederer, Aberdeen, Great Britain; Alan Dee Huffstutler; Harry Morales Campos, Jr., both of Grand Prairie, Tex.

[73] Assignee: Dresser Industries, Inc., Dallas, Tex.

[ * ] Notice: The term of this patent shall not extend beyond the expiration date of Pat. No. 5,553,681.

[21] Appl. No.: 675,626

[22] Filed: Jul. 3, 1996

Related U.S. Application Data

[63] Continuation-in-part of Ser. No. 351,019, Dec. 7, 1994, Pat. No. 5,547,033, and Ser. No. 350,910, Dec. 7, 1994, Pat. No. 5,553,681.

[51] Int. Cl.[6] ..... E21B 10/08; E21B 10/50

[52] U.S. Cl. ..... 175/331; 175/339; 175/374

[58] Field of Search ..... 175/331, 354, 175/339, 394, 374, 375, 325.2

[56] References Cited

U.S. PATENT DOCUMENTS

| | | | |
|---|---|---|---|
| Re. 19,339 | 10/1934 | Vertson . | |
| Re. 32,495 | 9/1987 | Coates | 175/339 |
| D. 265,205 | 6/1982 | Munson | D15/139 |
| 1,906,427 | 5/1933 | Sievers et al. . | |
| 1,908,049 | 5/1933 | Reed . | |

(List continued on next page.)

FOREIGN PATENT DOCUMENTS

| | | |
|---|---|---|
| 936382 | 12/1955 | Germany . |
| 533719 | 10/1975 | Russian Federation . |
| 732483 | 8/1980 | Russian Federation . |
| 1305295 | 4/1987 | Russian Federation . |
| 1467157 | 3/1989 | Russian Federation . |

OTHER PUBLICATIONS

U.S. Pat. application Ser. No. 08/287,441, filed Aug. 8, 1994 and entitled *Rotary Cone Drill Bit With Improved Support Arms.*

U.S. Pat. application Ser. No. 08/287,390, filed Aug. 8, 1994 and entitled *Rotary Cone Drill Bit And Method For Manufacture And Rebuild.*

U.S. Pat. application Ser. No. 08/350,910, filed Aug. 8, 1994 and entitled *Rotary Cone Drill Bit With Improved Support Arms.*

(List continued on next page.)

*Primary Examiner*—David J. Bagnell

*Attorney, Agent, or Firm*—Baker & Botts, L.L.P.

[57] ABSTRACT

A rotary cone drill bit for forming a borehole having a bit body with an upper end portion adapted for connection to a drill string. A number of support arms extend from the bit body. Each support arm has an exterior surface with a stabilizer pad formed as an integral part thereof. A number of cutter cone assemblies equal to the number of support arms are rotatably mounted on respective support arms and project generally downwardly and inwardly from each support arm. A ramp may also be formed on the exterior surface of the support arm as an integral part thereof. Both the stabilizer pad and the ramp preferably have surfaces inclined at an angle from a leading edge of the support arm toward a trailing edge of the support arm such that a fluid flow channel is formed therebetween to direct drilling fluids and cuttings to flow upward in the borehole.

23 Claims, 3 Drawing Sheets

U.S. PATENT DOCUMENTS

| | | | |
|---|---|---|---|
| 2,030,723 | 2/1936 | Scott et al. . | |
| 2,047,112 | 7/1936 | Reed . | |
| 2,063,012 | 12/1936 | Catland . | |
| 2,065,743 | 12/1936 | Reed . | |
| 2,068,375 | 1/1937 | Catland . | |
| 2,124,521 | 7/1938 | Williams et al. . | |
| 2,151,347 | 3/1939 | Fisher . | |
| 2,176,358 | 10/1939 | Pearce . | |
| 2,260,487 | 10/1941 | Scott . | |
| 2,318,370 | 5/1943 | Burch . | |
| 2,634,105 | 4/1953 | Gruner . | |
| 2,648,526 | 8/1953 | Lanchester . | |
| 2,782,005 | 2/1957 | Appleton . | |
| 2,807,444 | 9/1957 | Reifschneider . | |
| 2,950,090 | 8/1960 | Swart . | |
| 3,130,801 | 4/1964 | Schumacher, Jr. | 175/374 |
| 3,442,342 | 5/1969 | McElya et al. | 175/374 |
| 3,628,616 | 12/1971 | Neilson | 175/375 |
| 3,800,891 | 4/1974 | White et al. | 175/374 |
| 3,825,083 | 7/1974 | Flarity et al. | 175/394 |
| 3,850,256 | 11/1974 | McQueen | 175/228 |
| 4,054,772 | 10/1977 | Lichte . | |
| 4,056,153 | 11/1977 | Miglierini | 175/376 |
| 4,067,406 | 1/1978 | Garner et al. | 175/341 |
| 4,098,448 | 7/1978 | Sciaky et al. . | |
| 4,145,094 | 3/1979 | Vezirian | 308/8.2 |
| 4,187,743 | 2/1980 | Thomas | 76/108 |
| 4,209,124 | 6/1980 | Baur et al. . | |
| 4,256,194 | 3/1981 | Varel | 175/375 |
| 4,258,807 | 3/1981 | Fischer et al. | 175/375 |
| 4,280,571 | 7/1981 | Fuller . | |
| 4,333,364 | 6/1982 | Varel . | |
| 4,350,060 | 9/1982 | Vezirian . | |
| 4,352,400 | 10/1982 | Grappendorf et al. | 175/330 |
| 4,369,849 | 1/1983 | Parrish | 175/340 |
| 4,417,629 | 11/1983 | Wallace | 175/365 |
| 4,421,184 | 12/1983 | Mullins | 175/337 |
| 4,552,232 | 11/1985 | Frear | 175/337 |
| 4,623,027 | 11/1986 | Vezirian | 175/340 |
| 4,624,329 | 11/1986 | Evans et al. | 175/374 |
| 4,630,693 | 12/1986 | Goodfellow | 175/366 |
| 4,635,728 | 1/1987 | Harrington | 166/341 |
| 4,657,091 | 4/1987 | Higdon | 175/229 |
| 4,711,143 | 12/1987 | Loukanis et al. . | |
| 4,727,943 | 3/1988 | Wood | 175/229 |
| 4,750,573 | 6/1988 | Wynn | 175/337 |
| 4,765,205 | 8/1988 | Higdon . | |
| 4,813,502 | 3/1989 | Dysart | 175/337 |
| 4,817,852 | 4/1989 | Hill | 228/114 |
| 4,848,491 | 7/1989 | Burridge . | |
| 4,986,375 | 1/1991 | Maher | 175/323 |
| 5,040,623 | 8/1991 | Vezirian | 175/354 |
| 5,074,367 | 12/1991 | Estes | 175/374 |
| 5,131,478 | 7/1992 | Brett et al. | 175/57 |
| 5,145,016 | 9/1992 | Estes | 175/331 |
| 5,158,148 | 10/1992 | Keshavan | 175/426 |
| 5,189,932 | 3/1993 | Palmo et al. | 76/108.2 |
| 5,199,516 | 4/1993 | Fernandez | 175/366 |
| 5,224,560 | 7/1993 | Fernandez | 175/374 |
| 5,281,260 | 1/1994 | Kumar et al. | 75/240 |
| 5,289,889 | 3/1994 | Gearhart et al. | 175/325.5 |
| 5,351,768 | 10/1994 | Scott et al. | 175/374 |
| 5,439,067 | 8/1995 | Huffstutler | 175/339 |
| 5,439,068 | 8/1995 | Huffstutler et al. | 175/356 |
| 5,553,681 | 9/1996 | Huffstutler et al. | 175/339 |

OTHER PUBLICATIONS

U.S. Pat. application Ser. No. 08/422,140, filed Apr. 13, 1995 and entitled *Rotary Drill Bit And Method For Manufacture And Rebuild.*

U.S. Pat. application Ser. No.08/478,455, filed Jun. 6, 1995 and entitled *Rotary Cone Drill Bit Modular Arm.*

U.S. Des. Pat. application Ser. No. 29/033,599 filed Jan. 17, 1995 and entitled *Rotary Cone Bit* (now abandoned).

U.S. Des. Pat. application Ser. No. 29/033,630, filed Jan. 17, 1995 and entitled *Support Arm And Rotary Cone For Modular Drill Bit.*

U.S. Des. Pat. application Ser. No. 29/043,782, filed Sep. 12, 1995 and entitled *Rotary Cone Drill Bit.*

Security/Dresser "Security Oilfield Catalog" Rock Bits, Diamond Products, Drilling Tools, *Security Means Technology* Nov. 1991–Nov. 1992 (p.25).

"State of the Science in Rock Bit Technology" by Carlos Fernandez, Spacebit (no date).

"Now Performing in the North Sea" Security DBS, New ERA™ Series, FM2000™ Series (1995).

"The 'New ERA' In Drill BitPerformance Has Arrived" Security DBS (no date).

International Search Report, International Application No. PCT/US95/10015, dated Jan. 4, 1996.

Brochure–"The First Truly Innovative Addition to the Rock Bit Technology Landscape in Decades", Security DBS (1996).

ROTARY CONE DRILL BIT WITH INTEGRAL STABILIZERS

RELATED APPLICATIONS

This application is a continuation-in-part of patent application Ser. No. 08/351,019 filed Dec. 7, 1994, now U.S. Pat. No. 5,547,033 (Attorney's Docket 060220.0178) and patent application Ser. No. 08/350,910, filed Dec. 7, 1994, now U.S. Pat. No. 5,553,681 (Attorney's Docket 060220.0179); and related to pending patent application Ser. No. 08/287,441 filed Aug. 8, 1994 (Attorney's Docket 060220.0171), and pending patent application Ser. No. 08/287,390 filed Aug. 8, 1994 (Attorney's Docket 060220.0172).

TECHNICAL FIELD OF THE INVENTION

This invention relates in general to the field of rotary drill bits used in drilling a borehole in the earth and in particular to a rotary cone drill bit with an integral stabilizer and an angled ramp formed on the exterior of each support arm.

BACKGROUND OF THE INVENTION

Various types of rotary drill bits or rock bits may be used to form a borehole in the earth. Examples of such rock bits include roller cone bits or rotary cone bits used in drilling oil and gas wells. A typical roller cone bit comprises a bit body with an upper end adapted for connection to a drill string. A plurality of support arms, typically three, depend from the lower end portion of the bit body with each arm having a spindle protruding radially inward and downward with respect to a projected rotational axis of the bit body.

Conventional roller cone bits are typically constructed in three segments. The segments may be positioned together longitudinally with a welding groove between each segment. The segments may then be welded with each other using conventional techniques to form the bit body. Each segment also includes an associated support arm extending from the bit body. An enlarged cavity or passageway is typically formed in the bit body to receive drilling fluids from the drill string. U.S. Pat. No. 4,054,772 entitled, Positioning System for Rock Bit Welding shows a method and apparatus for constructing a three cone rotary rock bit from three individual segments. U.S. Pat. No. 4,054,772 is incorporated by reference for all purposes within this application.

A cutter cone is generally mounted on each spindle and supported rotatably on bearings acting between the spindle and the inside of a spindle receiving cavity in the cutter cone. One or more nozzles may be formed on the underside of the bit body adjacent to the support arms. The nozzles are typically positioned to direct drilling fluid passing downwardly from the drill string through the bit body toward the bottom of the borehole being formed. Drilling fluid is generally provided by the drill string to perform several functions including washing away material removed from the bottom of the borehole, cleaning the cutter cones, and carrying the cuttings radially outward and then upward within the annulus defined between the exterior of the bit body and the wall of the borehole. U.S. Pat. No. 4,056,153 entitled, Rotary Rock Bit with Multiple Row Coverage for Very Hard Formations and U.S. Pat. No. 4,280,571 entitled, Rock Bit show examples of conventional roller cone bits with cutter cone assemblies mounted on a spindle projecting from a support arm. U.S. Pat. No. 4,056,153 and U.S. Pat. No. 4,280,571 are incorporated by reference for all purposes within this application.

During drilling with rotary cone drill bits and rock bits, fluid flow in the vicinity of the drill bits is very turbulent.

Also, fluid flow in the annulus between the exterior of the associated drill string and the sidewall of the borehole is also often very turbulent and non-uniform. These variations in fluid flow along with rotation and vibration of the associated drill string, frequently require stabilizing the drill string and drill bit within the borehole. Various types of stabilizers and/or centralizers have previously been used as part of a downhole drilling assembly. For some applications, a stabilizer may be a separate component attached to the drill string above the drill bit. For other applications, stabilizer pads or lugs have been welded to the exterior of a drill bit after original manufacture and sale of the drill bit. For example, Security Dresser has developed stabilizer pads or lugs to provide additional bit stabilization and shirttail protection during severe downhole drilling applications. Such stabilizer pads are typically most effective during drilling of horizontal and directional well bores which result in sideloading of the associated drill bit and premature drill bit failure due to increased abrasion, erosion, and/or wear of the shirttail portion. Such stabilizer pads or lugs are generally manufactured as a separate component and attached to the exterior of a selected drill bit by welding. Flush surface tungsten carbide inserts may be included as part of the stabilizer pad or lug to further enhance abrasion, erosion and/or wear resistance.

SUMMARY OF THE INVENTION

In accordance with teachings of the present invention, disadvantages and problems associated with previous rock bits and rotary cone drill bits have been substantially reduced or eliminated. In one embodiment, the present invention includes a support arm and cutter cone assembly which provides enhanced fluid flow around the exterior of an associated rotary cone drill bit to remove cuttings and other debris from the bottom of a borehole to the well surface. A stabilizer pad or lug is preferably formed as an integral part of the exterior surface of each support arm.

Technical advantages of the present invention include providing a stabilizer pad or lug as an integral part of each support arm to eliminate the need to add a stabilizer as an additional component in the drill string above the drill bit and the associated extra threaded connections. Integral stabilizer pads formed in accordance with the teachings of the present invention are not subject to cracking and/or corrosion associated with lugs or pads added to previously manufactured drill bit using welding processes such as weld-overlay or welding a separate pad to each support arm after manufacture of the drill bit.

The present invention allows fabricating a stabilizer pad as an integral part of a support arm prior to attaching the support arm with its associated bit body. As a result of the present invention, compacts and/or inserts may be installed within the integral stabilizer pad and/or hardfacing material applied to the exterior of the stabilizer pad prior to assembly of the support arm with its associated bit body. Alternatively, the stabilizer pad may be manufactured with one or more holes to accommodate installing inserts after the associated drill bit has been assembled.

One aspect of the present invention includes fabricating each support arm with an integral stabilizer pad or lug and applying hardfacing to the exterior of the integral stabilizer pad prior to securing the support arm with the associated bit body to minimize abrasion, erosion and/or wear of the respective support arm. Forming the stabilizer pad as an integral part of the respective support arm allows selecting various configurations such as spiraled or straight to optimize the performance of the associated drill bit. Also, multiple integral stabilizer pads may be formed on the exterior of each support arm.

The present invention allows optimizing the location of the integral stabilizer pad on the exterior of the associated support arm without possibly damaging internal components such as a lubricant reservoir or bearing seals. Welding techniques associated with attaching stabilizer pads to the exterior of a previously manufactured drill bit frequently limit suitable locations for attaching the separate stabilizer pad to the exterior of the drill bit. Thus, fabrication of a stabilizer pad as an integral part of each support arm prior to assembly of the resulting drill bit may be optimized without concern for potential heat damage to other components.

Another aspect of the present invention includes providing a ramp on the exterior surface of each support arm. The ramp is preferably formed at an angle such that a top surface of the ramp slopes generally upward from the leading edge to the trailing edge of the support arm. The ramp has a predetermined thickness to provide a gap between the exterior surface of the support arm and the sidewall of the borehole above the ramp.

In accordance with the teachings of the present invention both a stabilizer pad and ramp are integrally formed on the exterior of each support arm. The stabilizer pad and ramp are preferably offset from each other to aid the flow of fluid, cuttings, and other debris from the bottom of the borehole to the annulus formed between the sidewall of the borehole and the exterior of the associated drill string.

Further technical advantages of the present invention include providing an integral stabilizer pad and associated ramp to divide turbulent fluid flow around the associated rotating cutter cones from fluid flow in the annulus above the drill bit such that cuttings and other debris entering the annulus will not be drawn back down toward the cutter cones. Fluid flow below the ramp is turbulent and multidirectional due to fluid exiting the associated nozzles and the churning effect of the cutter cones. Fluid flow above the stabilizer pad is relatively less turbulent and unidirectionally upward.

The outside dimensions of both the integral stabilizer pad and the associated ramp are preferably substantially equal to the desired radius for the borehole. Thus, vibration and lateral movement of the associated drill bit at the bottom of the borehole during drilling operations is substantially reduced or eliminated. By forming both the stabilizer pad and the ramp as integral components of each support arm, their corresponding dimensions (thickness, length, width, and exterior radius) may be optimized to enhance downhole drilling performance of the resulting rotary cone drill bit. Teachings of the present invention allow substantially improved quality control and substantially reduced variation in dimensional tolerances. The stabilizer pad and the ramp cooperate with other components of the bit body to separate fluid flow at the drill bit into two substantially independent regions.

Other technical advantages of the present invention includes eliminating forged nozzle bosses associated with conventional rotary cone drill bits which results in an increase in annular flow area around the exterior of the drill bit. The increased annular flow area in cooperation with the integral stabilizer pad and the ramp on each support arm provides enhanced fluid flow of cuttings and other borehole debris from the bottom of the borehole to the well surface. Increasing the annular area between the exterior of the drill bit and the sidewall of the borehole substantially reduces scoring or plowing of the sidewall while tripping the associated drill string and drill bit. Scoring or plowing of the sidewall is a significant concern in directional and/or extended reach horizontal drilling applications. For some downhole applications, the length of each support arm may be increased to provide two or more integral stabilizer pads for even greater downhole drilling stability.

Still further technical advantages which result from using a drill bit incorporating various teachings of the present invention include improved downhole cleaning, higher fluid flow rate capabilities, reduced bit balling problems, more consistent uniform downhole drilling performance and reduced directional drilling problems by eliminating "plowing" or scoring of the well bore sidewall while tripping the associated drill bit.

The open area provided between the lower portion or dome of the bit body and the associated cutter cone assemblies in combination with an angled shirttail ramp having a layer of hardfacing and an enhanced fluid flow return area combined to prevent packing of cuttings and substantially reduce abrasion, erosion and/or wear of the various components of the drill bit. As a result, seal life is substantially lengthened to increase the downhole drilling time for the associated drill bit. Drill bits incorporating teachings of the present invention have demonstrated longer downhole drilling life, higher rate of penetration (ROP) and lower total drilling costs.

BRIEF DESCRIPTION OF THE DRAWINGS

For a more complete understanding of the present invention, and the advantages thereof, reference is now made to the following description taken in conjunction with the accompanying drawings in which like reference numbers indicate like features and wherein.

DETAILED DESCRIPTION OF THE INVENTION

The present invention and its advantages are best understood by referring to FIGS. 1 through 6 of the drawings, like numerals being used for like and corresponding parts of the drawings.

Figure 1:
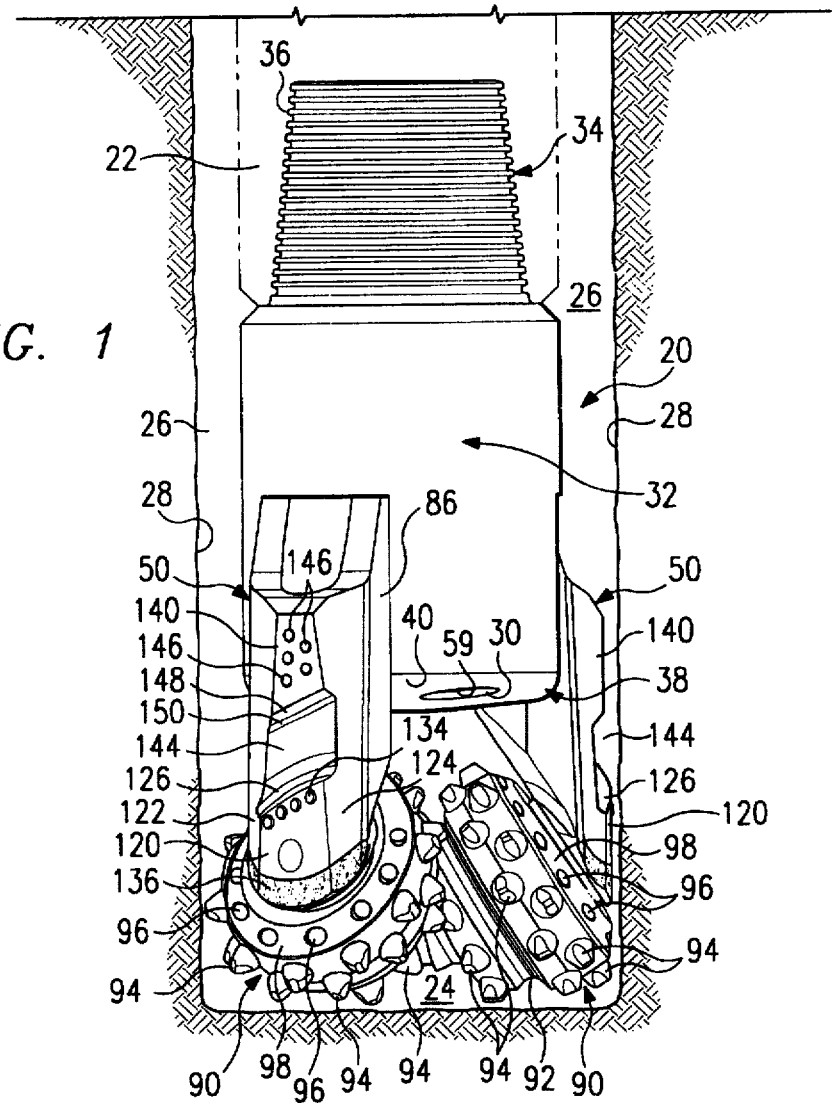
FIG. 1 is a schematic drawing in elevation and section with portions broken away of a rotary cone drill bit incorporating features of the present invention attached to one end of a drill string disposed in a borehole.

FIG. 1 is a schematic drawing showing an isometric view of a rotary cone drill bit indicated generally at 20, incorporating various teachings of the present invention. Drill bit 20 is shown attached to drill string 22 disposed within borehole 24. Annulus 26 is formed between the exterior of drill string 22 and sidewall 28 of borehole 24. In addition to rotating drill bit 20, drill string 22 is used as a conduit to communicate drilling fluids and other fluids from the well surface to drill bit 20 at the bottom of borehole 24. Such drilling fluids may be directed to flow from drill string 22 through bit body 32 to various nozzles 30 provided in drill bit 20. Cuttings formed by drill bit 20 and other debris at the bottom of borehole 24 will mix with the drilling fluid exiting from one or more nozzles 30 and return to the well surface via annulus 26.

Figure 4:
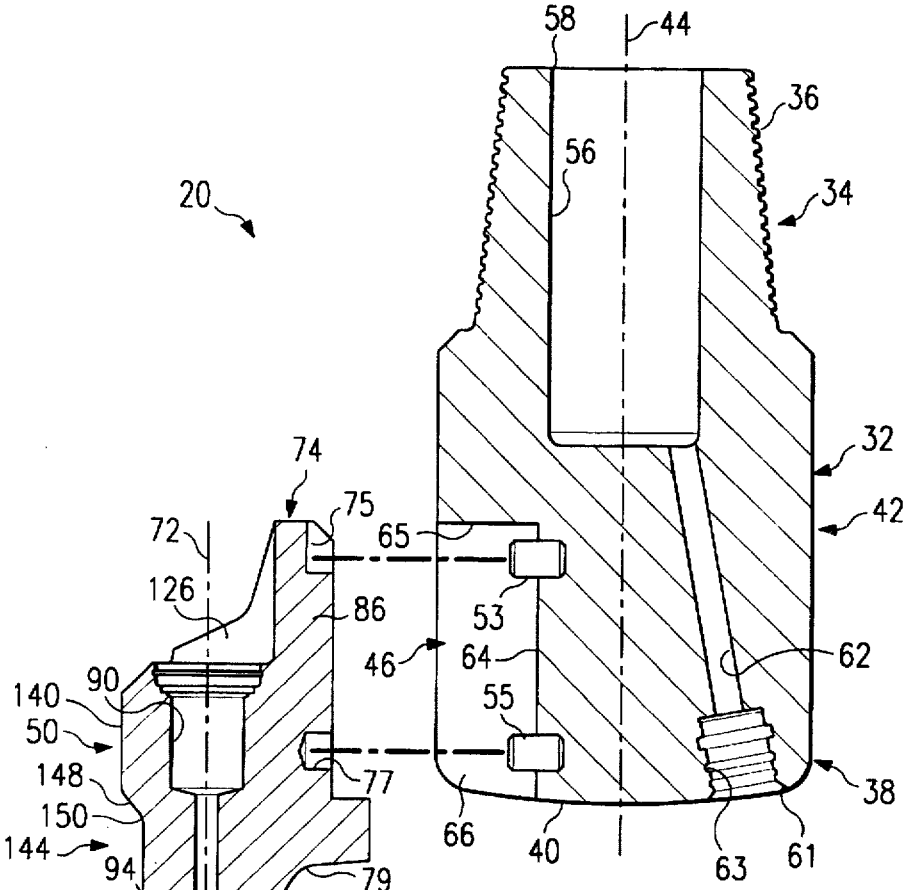
FIG. 4 is an exploded drawing in section with portion broken away showing portions of a one-piece bit body, support arm, and cutter cone assembly incorporating an embodiment of the present invention.
Figure 5:
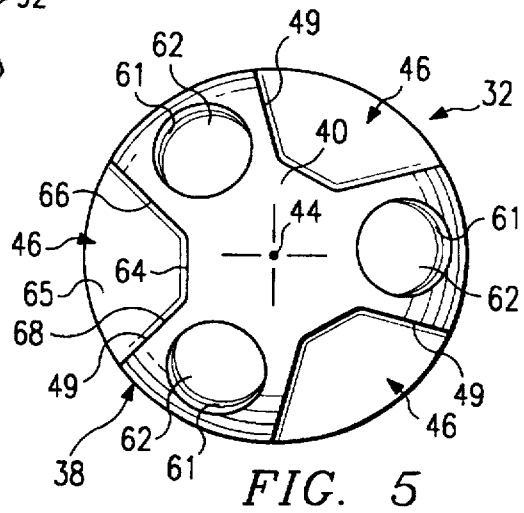
FIG. 5 is an end view of the bit body shown in FIG. 4.

As shown in FIGS. 1, 4 and 5, drill bit 20 preferably comprises a one piece or unitary bit body 32.

Bit body 32 includes upper portion 34 having threaded connection or pen 36 adapted to secure drill bit 20 with the lower end of drill string 22. Three support arms 50 are preferably attached to and extend longitudinally from bit body 32 opposite from threaded connection 36. Only two support arms 50 and cutter cone assemblies 90 are shown in FIG. 1.

Each support arm 50 preferably includes spindle 52 connected to and extending from inside surface of the respective support arm 50. Cutter cone assemblies 90 are rotatably mounted on respective spindles 52 which extend generally downward and inward from each support arm 50. An important feature of the present invention includes the ability to fabricate ramp 120 and stabilizer pad 140 as an integral parts of exterior surface 54 of each support arm 50 prior to attaching support arms 50 to bit body 32.

U.S. Pat. No. 5,439,067 entitled Rock Bit With Enhanced Fluid Return Area and U.S. Pat. No. 5,439,068 entitled Modular Rotary Drill Bit provide additional information concerning the manufacture and assembly of unitary bit bodies, support arms and cutter cone assemblies which are satisfactory for use with the present invention. Both of these patents are incorporated by reference for all purposes within this application.

Bit body 32 includes lower portion 38 having a generally convex exterior surface 40 formed thereon. Lower portion 38 may sometimes be referred to as a dome. The dimensions of convex surface 40 and the location of cutter cone assemblies 90 relative to lower portion 38 may be varied by adjusting the length of the support arms 50 and the spacing of each support arm 50 on the exterior of bit body 32. One or more nozzles 30 are preferably formed within lower portion 38 of bit body 32 to supply drilling fluid from the well surface through drill string 22 to drill bit 20 for removal of cuttings and other downhole debris created by drill bit 20. The number of nozzles 30 and their location within bit body 32 may be varied depending upon the intended downhole drilling application.

Debris carrying drilling fluid will generally flow radially outward between convex surface 40 and the bottom of borehole 24 and then flow generally upward toward the well surface through annulus 26. For the embodiment of the present invention as shown in FIGS. 1–5, bit body 32 includes three nozzles 30 and their associated fluid flow passage ways which will be discussed later in more detail.

Forming nozzles 30 and their associated fluid flow passages within unitary bit body 32 eliminates the requirement to form nozzle bosses associated with conventional drill bits on the exterior of bit body 32. One result of forming nozzles 30 within bit body 32 in accordance with teachings of this present invention is a substantially enlarged fluid flow area between the exterior of drill bit 20 and sidewall 28 of borehole 24. Also, the location of nozzles 30 provides a relatively smooth exterior surface for bit body 32 which minimizes scoring and/or plowing of sidewall 28 while tripping drill string 22 and drill bit 20 in and out of borehole 24. Scoring or plowing of sidewall 28 is of particular concern for horizontal or highly deviated boreholes.

Figure 2:
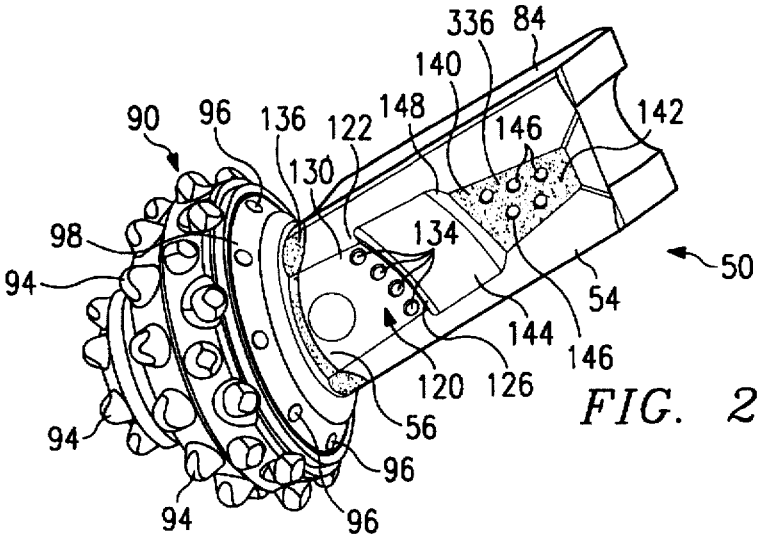
FIG. 2 is an isometric drawing showing a support arm and cutter cone assembly having both an integral stabilizer pad and ramp in accordance with teachings of the present invention.

As shown in FIGS. 1, 2 and 4, each cutter cone assembly 90 includes grooves 92 along with protruding inserts 94 which scrape and gouge against the sides and bottom of borehole 24 in response to weight and rotation applied to drill bit 20 by drill string 22. The position of grooves 92 and inserts 94 for each cutter cone assembly 90 may be varied to provide the desired downhole drilling action. Other types of cutter cone assemblies may be satisfactorily used with the present invention including, but not limited to, cutter cone assemblies having milled teeth instead of inserts 94. A plurality of surface compacts 96 are disposed in gauge face surface 98 of each cutter cone assembly 90. Inserts 94 and surface compacts 96 may be formed from various types of hard materials associated with the manufacture of downhole drill bits.

Ramp 120 and stabilizer pad 140 are formed on exterior surface 54 as an integral part of each support arm 50 in accordance with teachings of the present invention to stabilize drill bit 20 within borehole 24 and to aid drilling fluid flow in carrying debris from the bottom of borehole 24 to the well surface. Ramp 120 and stabilizer pad 140 preferably extend radially from each support arm 50 a distance which is approximately equal to the desired radius for borehole 24.

For one application, outer surface 130 of ramp 120 and outer surface 142 of stabilizer pad 140 are separated from sidewall 28 of borehole 24 by a nominal distance of approximately 0.03 inches. Therefore, contact between the exterior of ramp 120 and/or stabilizer pad 140 and adjacent portions of sidewall 28, may occur depending upon specific downhole drilling conditions. For purposes of illustration, a relatively large gap is shown in FIG. 1 between exterior surfaces 130 and 142 and sidewall 28. Both ramps 120 and stabilizer pads 140 may be protected by inserts and/or hardfacing which will be described later in more detail.

Stabilizer pad 140 is preferably spaced longitudinally from the associated ramp 120 to form fluid flow channel 144 between each support arm 50 and sidewall 28 of borehole 24. Fluid flow channels 144 cooperate with each other to direct turbulent fluid flow and cuttings from the bottom of borehole 24 upwardly into annulus 26. One of the benefits of combining stabilizer pad 140 with ramp 120 is increased separation of turbulent fluid in the vicinity of cutter cone assemblies 90 at the bottom of borehole 24 from generally upward fluid flow in annulus 26 above support arms 50. For some downhole drilling applications only stabilizer pad 140 may be required on exterior surface 54 of support arm 50. Alternatively only ramp 120 may be required for other applications.

Figure 3:
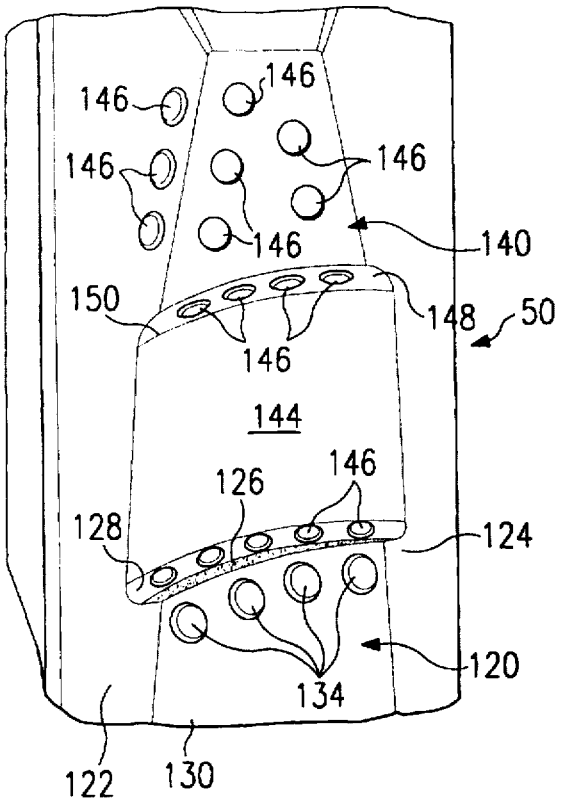
FIG. 3 is an enlarged drawing in elevation with portions broken away showing the integral stabilizer pad and ramp on the exterior surface of the support arm of FIG. 2 with additional inserts or compacts to reduce erosion and wear from downhole fluid flow.

As shown in FIGS. 1, 2 and 3, ramp 120 is protected by a plurality of inserts 134 and hardfacing layer 136. Inserts 134 are disposed in ramp 120 adjacent to top surface 126. Hardfacing layer 136 is disposed on the lower edge of shirttail portion 56. Hardfacing layer 136 may comprise, for example, chips or particles of tungsten carbide or other appropriate material for resisting erosion, abrasion and wear.

As shown in FIGS. 1, 2 and 3, stabilizer pad 140 may also be protected by a plurality of inserts or surface compacts 146 disposed in outer surface 142. Various types of hardfacing 336 may also be formed on outer surface 142 in addition to inserts 146. By initially manufacturing support arm 50 as a separate component from bit body 32 and cutter cone assembly 90 various fabrication and manufacturing techniques may be used to form ramp 120 and/or stabilizer pad 140 which would not be compatible with forming the same type of ramp and/or stabilizer pad on the exterior portion of a conventional rotary cone drill bit.

As shown in FIGS. 2 and 3, each support arm 50 includes leading edge 122 and trailing edge 124 disposed on opposite sides of exterior surface 54. Drill string 22 preferably rotates rotary cone drill bit 20 to the right to form borehole 24 while drilling fluid is ejected from nozzles 30 toward cutter cones 90. Thus, ramp 120 at leading edge 122 will pick up cuttings and fluids from the bottom of borehole 24. The fluid and cuttings move up along top surface 126 within channel 144 toward trailing edge 124 of each support arm 50 and flow upward into annulus 26 toward the well surface. Fluid flow channel 144 is defined in part by top surface 126 of ramp 120, bottom surface 148 of stabilizer pad 140 and the portion of exterior surface 54 disposed between ramp 120 and pad 140.

Top surface 126 of ramp 120 and bottom surface 148 of stabilizer pad 140 preferably slope generally upward along exterior surface 54 of support arm 50 from leading edge 122 to trailing edge 124. Top surface 126 and bottom surface 148 may comprise a flat surface, a concave surface, or any other appropriate configuration to aid in removal of cuttings and other debris from borehole 24.

As best shown in enlarged FIG. 3, top surface 126 and bottom surface 148 comprises concave surfaces having respective predetermined radius of curvature shown at 128 and 150. Top surface 126 and bottom surface 148 extend radially from exterior surface 54. Top surface 126 and bottom surface 148 may be disposed lower on support arm 50 if nozzles 30 are located closer to the center of bit body 32. It is desirable to have the entrance to channel 144 as low as possible on support arm 50 to aid in removal of cuttings and other debris. The thickness of ramp 120 and stabilizer pad 140 may be chosen such that respective outer surfaces 130 and 142 are located at a desired distance from sidewall 28 of borehole 24.

Ramp 120 and stabilizer pad 140 are preferably formed as integral parts of exterior surface 54 of each support arm 50. For some applications, ramp 120 and stabilizer pad 150 may be formed as an integral part of support arm 50 by machining an appropriately sized piece of raw material. Ramp 120 and stabilizer pad 120 may also be formed as an integral part of support arm 50 during forging of support arm 50. After support arm 50 has been forged, ramp 120 and stabilizer pad 140 may be further machined to define their desired dimensions and shape including the slope of top surface 126 and bottom surface 148.

The slope and structure of ramp 120 and stabilizer pad 140 may be varied without departing from the teachings of the present invention. For example, ramp 120 and stabilizer pad 140 may have linear slopes from leading edge 122 to trailing edge 124 along exterior surface 54. Alternatively, ramp 120 and stabilizer pad 140 may have nonuniform slopes and/or widths across exterior surface 54.

For some applications, it may be desirable to install one or more inserts 146 on leading edge 122 adjacent to the opening for channel 144. Also, inserts 146 may be installed within top surface 126 and bottom surface 148 as shown in FIG. 3. Inserts 146 thus cooperate with each other to minimize erosion, abrasion and wear from fluid flow adjacent to leading edge 122 and surfaces 126 and 148 of flow channel 144. Various types of inserts or compacts may be satisfactorily used as inserts 146. Such inserts include but are not limited to tungsten carbide inserts, polycrystalline diamond inserts, or other suitable hard materials compatible with the associated downhole drilling environment.

As shown in FIGS. 1 and 4, bit body 32 includes middle portion 42 disposed between upper portion 34 and lower portion 38. Longitudinal axis or central axis 44 extends through bit body 32 and corresponds generally with the projected axis of rotation for drill bit 20. Middle portion 42 preferably has a generally cylindrical configuration with pockets 46 formed in the exterior thereof and spaced radially from each other. The number of pockets 46 is selected to correspond with the number of support arms 50 which will be attached thereto. The spacing between pockets 46 in the exterior of middle portion 42 is selected to correspond with the desired spacing between support arms 50 and their associated cutter cone assemblies 90. The location of pockets 46 may also be varied to provide any desired offset for cutter cone assemblies 90 with respect to longitudinal axis 44 and the projected axis of rotation for drill bit 20.

Each support arm 50 has a longitudinal axis 72 extending therethrough. Support arms 50 are preferably mounted in their respective pockets 46 with their respective longitudinal axis 72 aligned parallel with each other and with longitudinal axis 44 of the associated bit body 32. For one application a portion of each support arm 50 is preferably welded within its associated pocket 46 by a series of welds (not expressly shown) formed between the exterior or perimeter of each pocket 46 and adjacent portions of the associated support arm 50. The perimeter of each pocket 46 adjacent to the exterior of bit body 32 may be modified to provide welding surfaces and/or welding grooves to assist in attaching each support arm 50 with its associated pocket 46.

FIG. 4 is an exploded drawing which shows the relationship between bit body 32, one of the support arms 50 and its associated cutter cone assembly 90. Each cutter cone assembly 90 is preferably constructed and rotatably mounted on its associated spindle 52 in a substantially identical manner. Each support arm 50 is preferably constructed and mounted in its associated pocket 46 in substantially the same manner. Therefore, only one support arm 50 and cutter cone assembly 90 will be described in detail since the same description applies generally to the other support arms 50 and their associated cutter cone assemblies 90.

Support arm 50 has a generally rectangular configuration with respect longitudinal axis 72. Support arm 50 may have various cross-sections taken normal to longitudinal axis 72 depending upon the configuration of the associated pocket 46, ramp 120 and stabilizer pad 140 along other features which may be incorporated into support arm 50 in accordance with the teachings of the present invention. Support arm 50 includes top surface 74, inside surface 76, bottom edge 78 and exterior surface 54. Support arm 50 also includes sides 84 and 86 which preferably extend substantially parallel with longitudinal axis 72.

Various features of the present invention may be incorporated as part of inside surface 76, exterior surface 54 and sides 84 and 86. The various dimensions of each support arm 50 are selected to be compatible with the associated pocket 46. As shown in FIGS. 1 and 4, a portion of each support arm 50 including upper end or top surface 74 and adjacent portions of inside surface 76 along with sides 84 and 86 extending therefrom, are sized to fit within the associated pocket 46.

Inside surface 76 may be modified as desired to provide various features of the present invention. The configuration of inside surface 76 may be varied substantially between top surface 74 and bottom edge 78. Also, the configuration of inside surface 76 with respect to sides 84 and 86 may be varied depending upon the configuration of the associated pockets. Inside surface 76 and exterior surface 54 are contiguous at bottom edge 78 of support arm 50. The portion of exterior surface 54 formed adjacent to bottom edge 78 is often referred to as shirttail portion 56. Ramp 120 may also be referred to as a shirttail ramp.

For one embodiment of the present invention, first opening 75 and second opening 77 are formed in inside surface 76 of each support arm 50. First post 53 and second post 55 may be formed on back wall 64 of each pocket 46. Post 53 and 55 extend radially from each back wall 64 to cooperate respectfully with first opening 75 and second opening 77 to position each support arm 50 within its associated pocket 46. For some applications, first opening 75 preferably comprises a longitudinal slot extending from top surface 74 and size to receive first post 53 therein. Second opening 77 preferably has a generally circular configuration to receive second post 55 therein. Posts 53 and 55 and openings 75 and 77 may be used to position each support arm 50 within the associated pocket 46 prior to welding.

Spindle 52 is preferably angled downwardly and inwardly with respect to both longitudinal axis 72 of support arm 50 and the projected axis of rotation of drill bit 20. This orientation of spindle 52 results in the exterior of cutter cone assembly 90 engaging the side and bottom of borehole 24 during drilling operations. For some applications, it may be preferably to position each support arm 50 and its associated spindle 52 with cutter cone assembly 90 at an offset from the projected axis of rotation of drill bit 20. The desired offset can be easily obtained by forming the associated pockets 46 in the exterior of bit body 32 with a corresponding offset from longitudinal axis 44 of bit body 32. The amount of offset may vary from zero to five or six degrees (6°) or approximately zero (0) inches to one half (½) inch in the direction of rotation of drill bit 20.

Each cutter cone assembly 90 includes base portion 108 with a conically shaped shell or tip 106 extending therefrom. For some applications, base portion 108 includes frustroconically shaped gauge face surface 98 which is preferably angled in a direction opposite from the angle of shell 106. Base 108 also includes backface 112 which may be disposed adjacent to portions of inside surface 76 of the associated support arm 50. Base 108 preferably includes opening 110 with chamber 114 extending therefrom. Chamber 114 extends through base 108 and into tip 106. The dimensions of opening 110 and chamber 114 are selected to allow mounting each cutter cone assembly 90 on its associated spindle 52. One or more bearing assemblies 116 may be mounted on spindle 52 and disposed between a bearing wall within chamber 114 and annular bearing surface 81 on spindle 52. A conventional ball retaining system 118 may be used to secure cutter cone assembly 90 to spindle 52.

As shown in FIG. 4, enlarged cavity 57 may be formed within upper portion 34 of bit body 32. Opening 58 is provided in upper portion 34 for communicating fluids between drill string 22 and cavity 57. Cavity 57 preferably has a generally uniform inside diameter extending from opening 58 to a position intermediate middle portion 42 of bit body 32. For some applications, cavity 57 may be formed concentric with longitudinal axis 44 of bit body 32. Cavity 57 and opening 58 provide a relatively large fluid chamber having little if any resistance to fluid flow from drill string 22 into drill bit 20.

One or more fluid passageways 62 may be formed in bit body 32 extending between cavity 57 and convex surface 40 on lower portion 38 of bit body 32. Opening 61 may be provided in each fluid passageway 62 adjacent to convex surface 40. A plurality of recesses 3 are preferably provided within each opening 61 to allow installing various types of nozzles or nozzle inserts 30 within each fluid passageway 62. Additional components (not shown) such as a snap ring and/or O-ring seal may be provided to position each nozzle insert 30 within recesses 63. Cavity 57 and passageways 62 cooperate with each other to provide improved fluid flow and enhanced cleaning efficiency at cutter cone assemblies 90.

Various techniques are commercially available for satisfactorily installing each nozzle 30 within its associated opening 61. For some applications, nozzles 30 may be formed from tungsten carbide or other suitable materials to resist erosion from fluids flowing therethrough. Also, one or more access ports (not shown) may be provided in bit body 32 adjacent to openings 61 to allow lock screws or pins and/or plug welds (not shown) to secure nozzles 30 within recesses 63.

Nozzles 30 preferably include one or more outlet orifices 59. Nozzles 30 may be disposed in each fluid passageway 62 to regulate fluid flow from cavity 57 through the respective fluid passageway 62 and the associated nozzle 30 to the exterior of bit body 32. The length and diameter of each fluid passageway 62 may be selected for some applications to provide laminar flow between cavity 57 and the respective nozzle 30. The present invention allows forming fluid passageway 62 with a diameter larger than previously possible with conventional rotary cone drill bits. The straight path from drill string 22 through cavity 57 and the large inside diameter of passageways 62 reduce turbulence and swirl to significantly minimize erosion or washout of nozzles 30 while at the same time providing very little resistance to high fluid flow rates.

An important feature of the present invention includes the ability to vary the position of fluid passageways 62 and associated nozzles 30 within bit body 32 without affecting the location of pockets 46 and the associated support arms 50. For some applications, nozzles 30 will preferably be positioned to direct drilling fluid flow between the associated cutter cone assemblies 90 at a location inside the full diameter of well bore 24. Nozzles on prior rotary drill cone bits often direct drilling fluid flow at the gauge diameter of the borehole which results in forcing a substantial volume of cuttings to flow from the outside diameter radially inward to the center of the borehole. This undesirable, inward flow path for cuttings results in significant inefficiencies from requiring the associated cutter cone assemblies to essentially redrill the same cuttings. The fluid flow pattern resulting from positioning nozzles 30 to direct fluid flow at a location spaced radially inward from the outside diameter of well bore 24 results in better cleaning of the drive row of inserts 94 on each cutter cone assembly 90 and directs a larger volume of cuttings to flow radially outwardly and upward from cutter cone assemblies 90. Moving the location of nozzles 30 inwardly towards centerline 44 of bit body 32 results in better flushing of cuttings and other debris from the bottom of borehole 24. As a result of improved cutting removal and better cleaning at the bottom of borehole 24, the efficiency and rate of penetration (ROP) of rotary cone drill bit 20 will be substantially improved.

FIG. 5 shows lower portion 38 of bit body 32 with three pockets 46 and three openings 61 for associated fluid passageways 62 spaced radially with respect to each other around the perimeter of bit body 32. For the specific example shown in FIG. 5, fluid passageways 62 and associated openings 61 are spaced radially approximately one hundred twenty degrees (120°) from each other. In a similar manner, each support pocket 46 is spaced radially approximately one hundred twenty degrees (120°) from an adjacent pocket 54.

Figure 6:
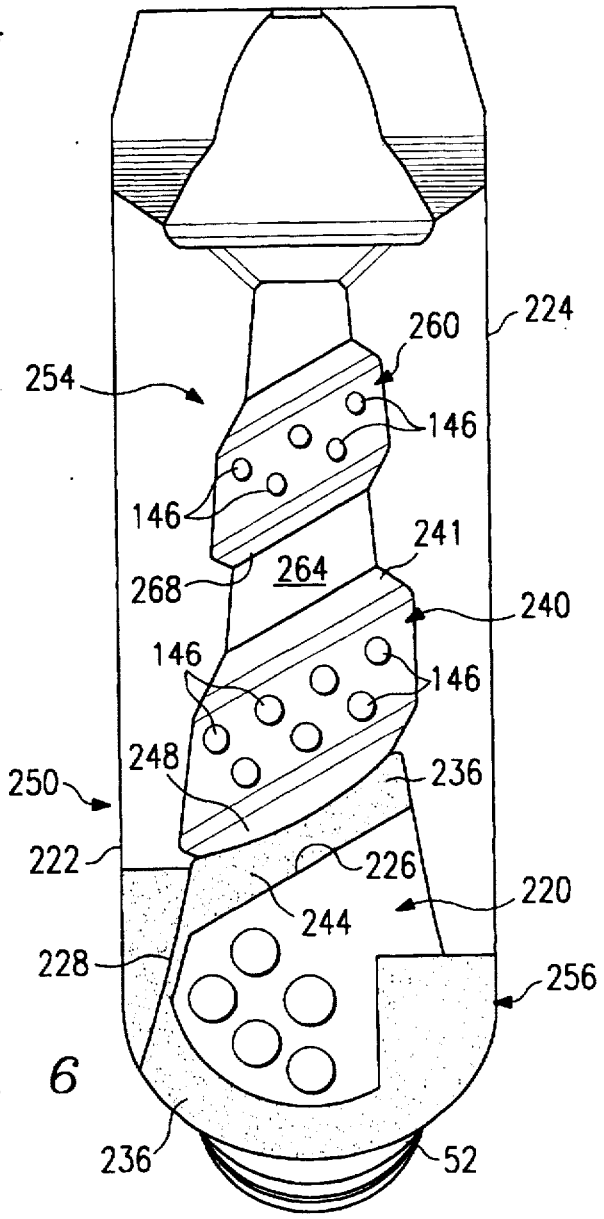
FIG. 6 is a drawing in elevation showing a support arm having an alternative embodiment of the present invention including two integral stabilizer pads.

FIG. 6 is enlarged drawing in elevation with portions broken away showing support arm 250 constructed according to teachings of the present invention. Support arm 250 is longer than previously described support arm 50 to accommodate first stabilizer pad 240 and second stabilizer pad 260 which are formed as an integral part of exterior surface 254. A plurality of inserts or surface compacts 146 may be installed in respective exterior surfaces 242 and 262 of stabilizer pads 240 and 260.

As previously noted, stabilizer pads 50, 240 and 260 are preferably manufactured as integral components of respective supporting arms 50 and 250. For some applications, stabilizer pads 50, 240 and 260 may be manufactured with only openings to receive corresponding inserts 146 and inserts 146 are not installed during the initial manufacture and assembly of the associated rotary cone drill bit. By not installing inserts 146 during the initial manufacture, it is possible to grind off or alter the configuration of one or more pads at a field location prior to using the associated rotary cone drill bit. Also, inserts 146 made from various types of material may be installed at the field location to correspond with the specific downhole drilling environment in which the associated rotary cone drill bit will be used.

Ramp 220 is preferably formed as an integral part of exterior surface 254 of support arm 250 adjacent to shirttail portion 256. Ramp 220 includes top surface 226 extending from leading edge 222 to trailing edge 224 to aid in removal of cuttings and other debris from the bottom of a borehole. Slot or channel 228 may be formed as part of leading edge 222 to assist in directing cuttings, debris and fluids upwardly from the lower edge of shirttail portion 56 to top surface 226 of ramp 220.

In addition to first stabilizer pad 240 an second stabilizer pad 260, hardfacing layer 236 is formed on a much larger portion of exterior surface 254 as compare to hardfacing layer 136 of support arm 50. As shown in FIG. 6 hardfacing layer 236 extends over much of exterior surface 254 corresponding with shirttail portion 256. Hardfacing layer 236 preferably covers to surface 226 of ramp 220. Also, hardfacing layer 236 extends into fluid flow channel 244 between top surface 226 of ramp 220 and bottom surface 248 of first stabilizer pad 240.

First stabilizer pad 240 is preferably spaced longitudinally from ramp 220 to define fluid flow channel 224 therebetween. The sides of fluid flow channel 244 are defined in part by top surface 226 of ramp 20 and bottom surface 268 of stabilizer pad 240. As previously noted the portion of exterior surface 254 disposed between bottom surface 268 and top surface 226 is preferably covered with hardfacing layer 236.

Second stabilizer pad 260 is preferably spaced longitudinally from first stabilizer pad 240 to form second fluid flow channel 264 on exterior surface 254 of support arm 250. The sides of fluid flow channel 264 are defined in part by top surface 241 of stabilizer pad 240 and bottom surface 268 of stabilizer pad 260. As previously noted an important advantage of forming stabilizer pads 240 and 260 and ramp 220 as integral parts of support arm 250 includes the ability to vary the dimensions and configurations of these components to optimize the downhole drilling performance of the associated rotary cone drill bit.

Although the present invention and its advantages have been described in detail, it should be understood that various changes, substitutions and alterations can be made therein without departing from the spirit and scope of the invention as defined by the appended claims. For example, the ramp may not extend along the entire width of a support arm.

What is claimed is:

1. A rotary cone drill bit for forming a borehole, comprising:

a bit body having an upper portion adapted for connection to a drill string for rotation of said bit body;

a number of support arms attached to and extending from said bit body, each of said support arms having a leading edge, a trailing edge, and an exterior surface disposed therebetween;

a number of cutter cone assemblies equaling said number of support arms and rotatably mounted on respective support arms with each cutter cone assembly projecting generally downwardly and inwardly with respect to its respective support arm;

a stabilizer pad formed as an integral part of said exterior surface of each of said support arms prior to attaching said support arms to said bit body; and said stabilizer pad projecting radially outward from said respective support arm a distance approximately equal to a desired radius for said borehole.

2. The drill bit of claim 1, wherein each stabilizer pad further comprises an exterior surface with hardfacing disposed thereon.

3. The drill bit of claim 1 wherein each stabilizer pad further comprises an exterior surface with a plurality of inserts disposed therein.

4. The drill bit of claim 1 further comprising:

at least two stabilizer pads formed as an integral part of said exterior surface of each of said support arms; and said stabilizer pads spaced longitudinally from each other to define a fluid flow channel between said stabilizer pads on said exterior surface of each support arm.

5. The drill bit of claim 4 further comprising:

a ramp formed on said exterior surface of each of said support arms;

each of said ramps having a top surface inclined at an angle from said leading edge of said respective support arm toward said trailing edge of said respective support arm;

said top surfaces of said ramps cooperating with each other to direct cuttings and fluid upwardly in said borehole; and a second channel formed on said exterior surface of each support arm between one of said stabilizer pads and said top surface of said ramp.

6. A rotary cone drill bit for forming a borehole, comprising:

a bit body having an upper portion adapted for connection to a drill string for rotation of said bit body;

a number of support arms attached to and extending from said bit body, each of said support arms having a leading edge, a trailing edge, and an exterior surface disposed therebetween;

a number of cutter cone assemblies equaling said number of support arms and rotatably mounted on respective support arms with each cutter cone assembly projecting generally downwardly and inwardly with respect to its respective support arm;

a stabilizer pad formed as an integral part of said exterior surface of each of said support arms prior to attaching said support arms to said bit body;

said stabilizer pad projecting radially outward from said respective support arm a distance approximately equal to a desired radius for said borehole;

said exterior surface of each support arm having a shirttail portion;

a ramp formed on said exterior surface of each of said support arms adjacent to said shirttail portion; and said ramp having a top surface inclined at an angle from said leading edge of said respective support arm toward said trailing edge of said respective support arm, such that said top surfaces of said ramps cooperate with each other to direct cuttings and fluid upwardly in said borehole.

7. The drill bit of claim 6, wherein said top surface of each ramp comprises a layer of hardfacing material.

8. The drill bit of claim 6, further comprising:

said top surface of said ramp having an approximately linear slope from said leading edge of said support arm to said trailing edge of said support arm; and said stabilizer pad having a bottom surface with a linear slope approximately equal to said slope of said top surface of said ramp.

9. The drill bit of claim 6, wherein said ramps project from said support arms a radial distance approximately equal to a maximum outer diameter of said drill bit such that as said drill bit is rotated in said borehole to form cuttings, said ramp forces said cuttings along said top surface of said ramp upwards and away from a bottom of said borehole.

10. The drill bit of claim 6 further comprising a channel formed on said exterior surface of each support arm between said stabilizer pad and said ramp.

11. A support arm and cutter cone assembly for a rotary cone drill bit having a bit body, comprising:

said support arm having a leading edge, a trailing edge, an exterior surface formed therebetween;

a shirttail portion provided as part of said exterior surface;

said cutter cone assembly rotatably mounted on said support arm and projecting generally downwardly and inwardly with respect to said support arm;

a first stabilizer pad formed on said exterior surface of said support arm as an integral part thereof during initial manufacture of said support arm; and said first stabilizer pad projecting radially from said exterior surface.

12. The support arm of claim 11, wherein said first stabilizer pad further comprises a bottom surface inclined at an angle from said leading edge of said support arm toward said trailing edge of said support arm.

13. The support arm of claim 11 further comprising said first stabilizer pad having a bottom surface with approximately a linear slope from said leading edge of said support arm to said trailing edge of said support arm.

14. The support arm of claim 11, wherein said first stabilizer pad further comprises a layer of hardfacing disposed thereon.

15. The support arm of claim 11, wherein said first stabilizer pad further comprises an exterior surface with a plurality of inserts disposed in said external surface.

16. The support arm of claim 11 further comprising:

a ramp formed on said exterior surface adjacent to said shirttail portion; and said ramp having a top surface inclined at an angle from said leading edge of said respective support arm toward said trailing edge of said respective support arm; such that said top surface of said ramp will direct cuttings and fluid upwardly in a well bore.

17. The support arm of claim 16 further comprising a channel formed on said exterior between said first stabilizer pad and said ramp.

18. A support arm and cutter cone assembly for a rotary cone drill bit having a bit body, comprising:

said support arm having a leading edge, a trailing edge, an exterior surface formed therebetween:

a shirttail portion provided as part of said exterior surface;

said cutter cone assembly rotatably mounted on said support arm and projecting generally downwardly and inwardly with respect to said support arm;

a first stabilizer pad formed on said exterior surface of said support arm as an integral part thereof during initial manufacture of said support arm;

said first stabilizer pad projecting radially from said exterior surface;

a second stabilizer pad formed as an integral part of said exterior surface of said support arm during initial manufacture of said support arm; and said second stabilizer pad spaced longitudinally from said first stabilizer pad to form a fluid flow channel therebetween.

19. The support arm of claim 18 further comprising:

said first stabilizer pad having a layer of hardfacing disposed thereon; and said second stabilizer pad having a layer of hardfacing disposed thereon.

20. The support arm of claim 18 further comprising:

said first stabilizer pad having an exterior surface with a plurality of inserts disposed therein; and said second stabilizer pad having an exterior surface with a plurality of inserts disposed therein.

21. A rotary cone drill bit for forming a borehole, comprising:

a bit body having an upper portion adapted for connection to a drill string for rotation of said bit body;

a number of support arms attached to and extending from said bit body, each of said support arms having a leading edge, a trailing edge, and an exterior surface disposed therebetween;

a number of cutter cone assemblies equaling said number of support arms and rotatably mounted on respective support arms with each cutter cone assembly projecting generally downwardly and inwardly with respect to its respective support arm;

a stabilizer pad formed as an integral part of said exterior surface of each of said support arms during initial manufacture of said support arms;

said stabilizer pads projecting radially outward from said respective support arms a distance approximately equal to a desired radius for said borehole;

a ramp formed on said exterior surface of each of said support arms, said ramp having a top surface inclined at an angle from said leading edge of said support arms toward said trailing edge of each of said support arms, such that said top surface of said ramps cooperate with each other to direct cuttings and fluid upwardly in said borehole;

said stabilizer pad spaced longitudinally from said ramp to form a fluid flow channel therebetween;

a plurality of inserts disposed in said ramp; and a hardfacing material disposed on said ramp adjacent to said channel.

22. A rotary cone drill bit for forming a borehole, comprising:

a bit body having an upper portion adapted for connection to a drill string for rotation of said bit body;

a number of support arms attached to and extending from said bit body, each of said support arms having a leading edge, a trailing edge, and an exterior surface disposed therebetween;

a number of cutter cone assemblies equaling said number of support arms and rotatably mounted on respective support arms with each cutter cone assembly projecting generally downwardly and inwardly from its respective support arm;

a ramp formed on said exterior surface of each of said support arms, each of said ramps having a top surface inclined at an angle from said leading edge of said respective support arms toward said trailing edge of said respective support arms, said ramps extending along said exterior surface of said respective support arms whereby said top surfaces cooperate with each other to direct cuttings and fluid upwardly in said borehole; and a layer of hardfacing material disposed on said top surface of said ramps.

23. A rotary cone drill bit of claim 22 further comprising:

a plurality of inserts installed in said leading edge of each of said support arms; and a plurality of inserts installed within said top surface of each of said ramps.

* * * * *